US005240752A

United States Patent [19]

Baghsarian

[11] Patent Number: 5,240,752

[45] Date of Patent: Aug. 31, 1993

[54] DECORATIVE CONTAINER

[76] Inventor: Avedis Baghsarian, 130 E. 65th St., New York, N.Y. 10021

[21] Appl. No.: 881,343

[22] Filed: May 11, 1992

[51] Int. Cl.[5] ..... A47G 7/06

[52] U.S. Cl. ..... 428/34.1; D11/154; 47/41.01; 428/65

[58] Field of Search ..... 428/34.1, 65, 7; D11/154; 47/41.01, 66

[56] References Cited

U.S. PATENT DOCUMENTS

| | | | |
|---|---|---|---|
| 2,080,523 | 5/1937 | Williams et al. | 428/18 |
| 2,111,109 | 3/1938 | Bolyard | 428/18 X |
| 3,345,240 | 10/1967 | O'Herron | 428/34.1 X |
| 3,788,372 | 1/1974 | Terenzoni | 428/34.1 X |
| 3,819,924 | 6/1974 | Thomas et al. | 428/65 X |
| 4,464,124 | 8/1984 | Tsuchie | 428/16 X |

*Primary Examiner*—Henry F. Epstein
*Attorney, Agent, or Firm*—Howard C. Miskin

[57] ABSTRACT

A decorative article such as a vase includes a tubular core which is engaged by central openings in flat or three-dimensional fin members which are separated by spacers alternating with the fin members. The spacers may be separate units or integrally formed with respective fin members. The fin members in each article may be of similar or different shapes and in one or more groups and of the same or different thicknesses and in the same or different orientation. The bottom of the core member is closed by a flanged cap member and a retainer member engages the top of the core member to lock the assembly of fin and spacer members to the core member.

16 Claims, 4 Drawing Sheets

DECORATIVE CONTAINER

The present invention relates generally to improvements in decorative articles and it relates more particularly to an improved decorative vase or the like.

Among articles of decoration, vases have been and are widely popular. These are usually of ceramic, glass, metal or other material and are of little or no versatility or adaptability as to appearance or application. The conventional vase is of fixed configuration and appearance permitting no modification in shape or color to match the surrounding decor and otherwise leaves much to be desired.

SUMMARY OF THE INVENTION

It is a principal object of the present invention to provide an improved decorative article.

Another object of the present invention is to provide an improved vase.

Still another object of the present invention is to provide an improved vase whose shape and appearance may be easily and widely adjusted.

A further object of the present invention is to provide a decorative article of the above nature which is of great versatility and adaptability, inexpensive, rugged and easy to employ and of highly attractive appearance.

The above and other objects of the present invention will become apparent from a reading of the following description taken in conjunction with the accompanying drawings which illustrate preferred embodiments thereof.

A decorative article in accordance with the present invention includes a longitudinally extending cylindrical core member, a plurality of longitudinally spaced fin members having preferably centrally located openings longitudinally slidably engaging the core member and a plurality of apertured spacer members slidably engaging the core member and interdigitating the fin members.

The spacer members are of lesser transverse dimensions than the fin members, the peripheral borders of successive fin member delineating respective peripheral grooves.

The core member is advantageously tubular and is closed at one end by a peripherally flanged cap member and is engaged at the other end by an annular member, the core assembled fin and spacer members being entrapped between the cap and annular member flanges. The fin and spacer members may be separate units or the fin members may have the spacer members individually integrally formed therewith. Moreover, the spacer members may be mounted on peripherally spaced rods projecting upwardly from a base member and engaging corresponding spaced holes in the fin members.

The fin members may be of any desirable shape, flat, conical, pyramidical or otherwise configured and may be circular, polygonal, oval or other shape. They may be formed of metal, plastic or other material, may be colored or otherwise decorated and the fins may vary in size and shape. In one embodiment of the invention, a pair of the core and fin assembly may be located side by-side with the fins of the assemblies being mutually interdigitating.

The improved decorative article is highly attractive and may be assembled and adjusted and related in almost endless shapes and is of great versatility and adaptability.

DESCRIPTION OF THE PREFERRED EMBODIMENTS

Figure 1:
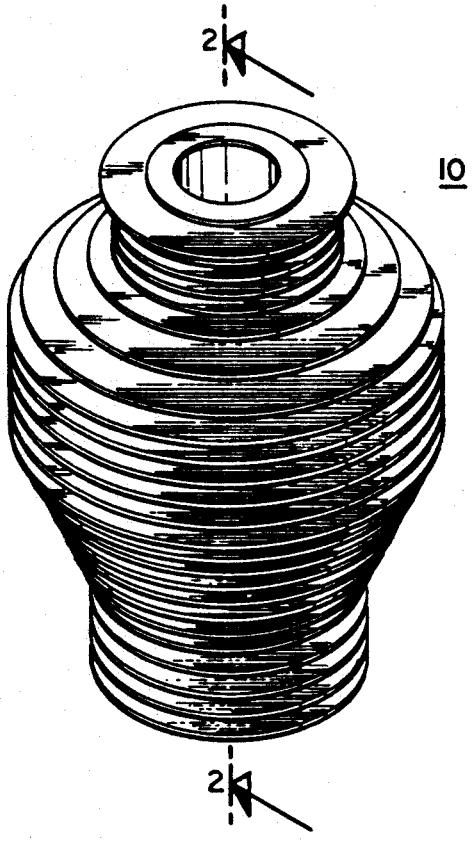
FIG. 1 is a front perspective view of a preferred embodiment of the present invention shown in assembled condition.
Figure 2:
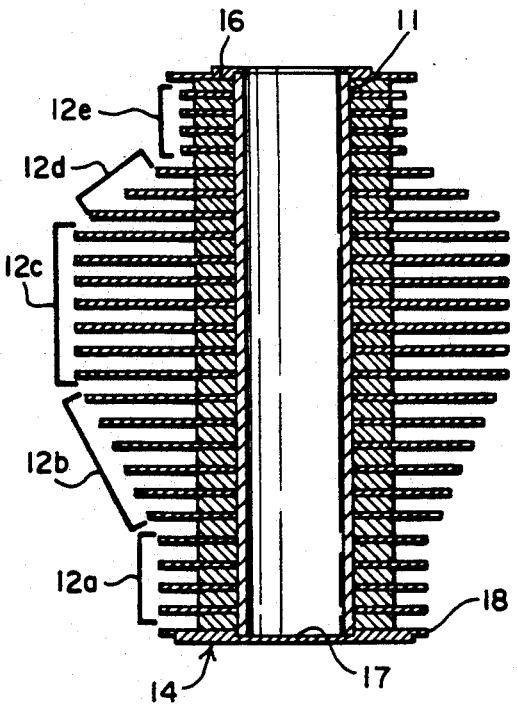
FIG. 2 is a sectional view taken along line 2—2 in FIG. 1.
Figure 3:
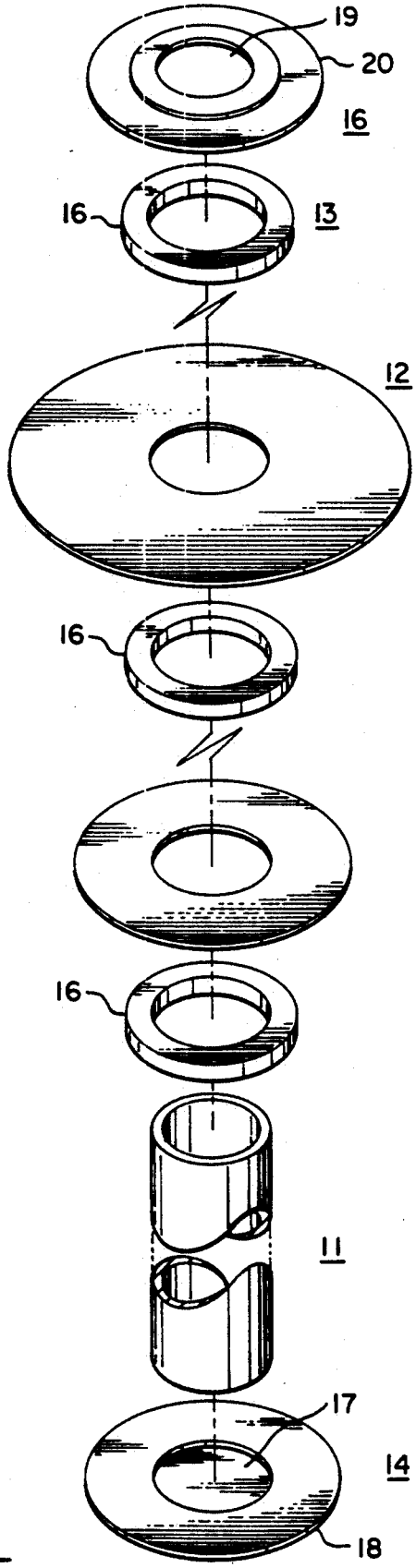
FIG. 3 is an exploded perspective view partially broken away.

Referring now to the drawings, particularly FIGS. 1 to 3 thereof which illustrate a preferred embodiment of the present invention, the reference numeral 10 generally designates the improved decorative article in the form of a vase which includes a hollow core or tubular body member 11, a plurality of fin members 12; a plurality of spacers 13, a bottom stop cap member 14 and a top retainer member 16.

Core member 11 is of open-ended circular tubular configuration extending vertically longitudinally and may be formed of any suitable material, metal, plastic, glass, ceramic or the like. The fin members 12 and spacers 13 may likewise be formed of any suitable material and in the illustrated embodiment are in the form of annuli, fin members 12 being in sets of equal and different outer diameters and spacers 13 being of equal diameters less than that of the smallest fin member 12. The diameters of the central openings of fin members 12 and spacers 13 are about equal to the outside diameter of core member 11.

Cap member 14 is circular with a flat bottom face and a central shallow circular top well 17 of a diameter about equal to the outside diameter of core member 11 and an upper flat peripheral flange 18. Retainer member 16 is of annular shape with a central opening 19 of a diameter about equal to the inside diameter of the core member 11 and having a flat peripheral flange 20 projecting outwardly from its bottom border to delineate an inside bottom peripheral shoulder.

In assembling the decorative device 10, the cap member is coaxially applied to the bottom of core member 11 which tightly engages the well 17 and may be cemented thereto or form a tight interference fit therewith. Spacers 13 and fins 12 are then successively alternately positioned in coaxial engagement with core member 11 with the diameters of the successive fins being related so as to achieve any desired overall appearance. In the illustrated embodiment, the lowermost group **12*a*** of first fin members 12 are of equal small diameters with the diameters of the upper next groups 12*b* of fin members 12 gradually increasing to a group 12*c* of fin member of equal diameters followed by a group 12*d* of fin members of decreasing diameter and then extending to the top of core member by a group 12*e* of equal smallest diameter fin members. The fin members 12 interdigitate with spacers 13 and the assembly of fin members and spacers is locked on core member 11 by retainer annulus 16 which tightly engages the top border of core member 11 and may be force fit thereon or cemented or otherwise secured thereto. The diameters of the fin members 12 as well as the thicknesses of spacers 13 may be varied as desired.

Figure 4:
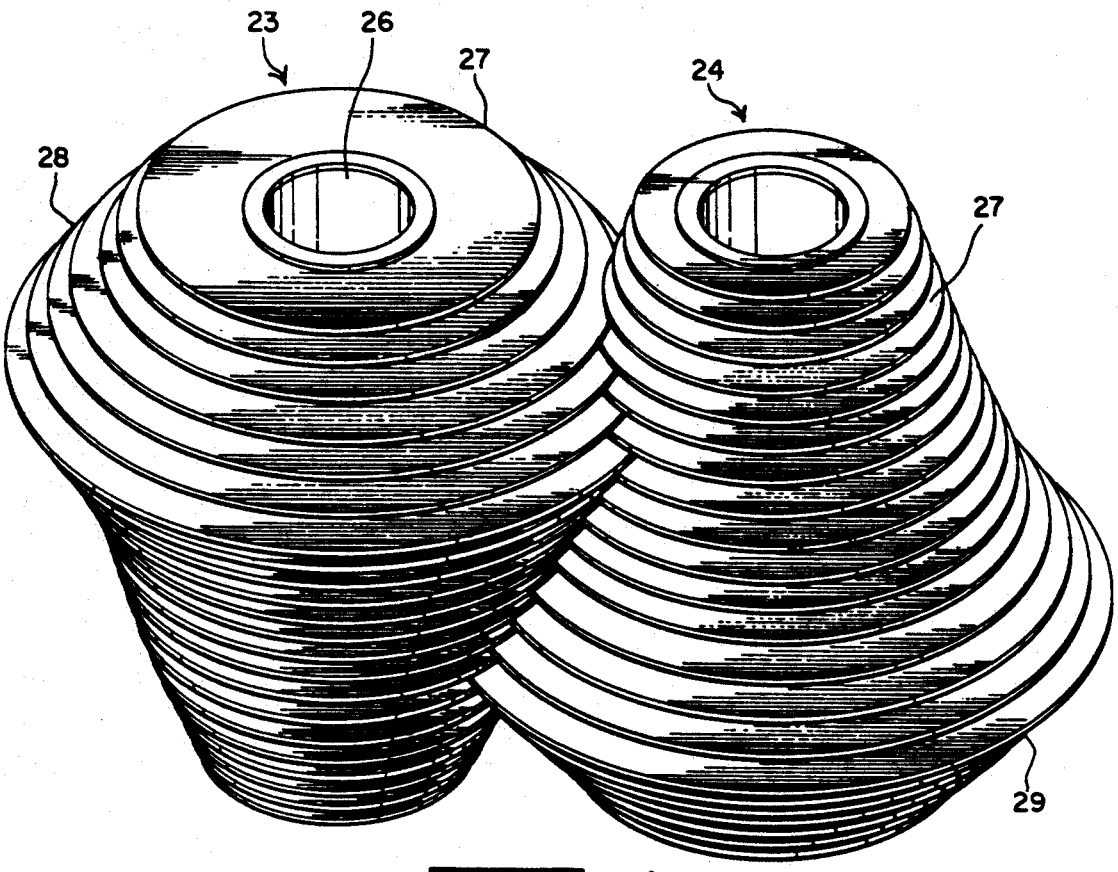
FIG. 4 is a front perspective view of another embodiment of the present invention.

In the embodiment illustrated in FIG. 4 of the drawings, two complementary shaped vase units 23 and 24 broadly of the construction of vase 10 described above, are arranged side-by-side with fin members thereof mutually overlapping and interdigitating. Each vase 23,24 includes a tubular core member 26 closed at its bottom by a flanged cup member and engaged by spacer separated annular fin members 27. The fin and spacer assembly on each core member 26 is locked in position by a retainer annulus as in the first embodiment. The fin members 27 on vase 23 are sized to produce a bulged section 28 at the upper part of the vase 23 whereas the fin members 27 on vase 24 are sized to produce a bulged section 29 of the lower part of vase 24. The fin members 27 of the vases 23 and 24 are mutually vertically offset and those forming the bulge in each vase project between those in the other vase.

Figure 5:
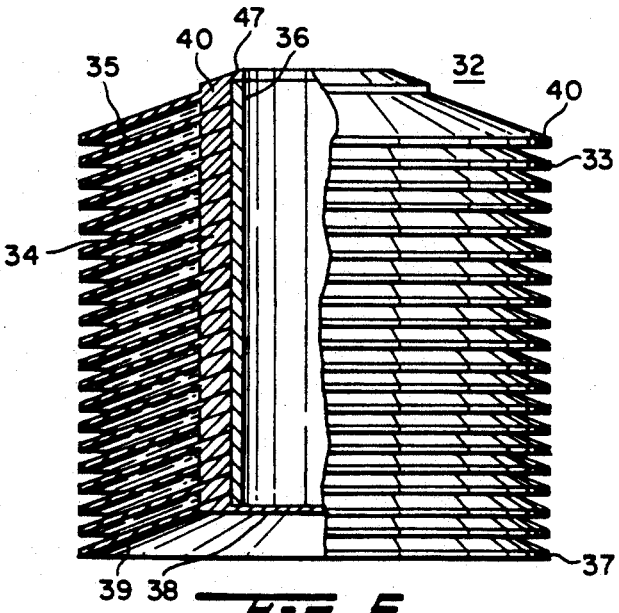
FIG. 5 is a front partially fragmented view of a further embodiment of the present invention.

Referring now to FIG. 5 of the drawings which illustrates another embodiment of the invention in which the modified vase 32 differs from that first described primarily in that the fin members 33 are frustoconically shaped and integrally formed with spacers 34. The vase 32 includes a tubular core 36 and each of the fin members 33 includes a centrally apertured downwardly outwardly inclined circular wall 35 having integrally formed therewith depending annular spacer 34 with top and bottom faces parallel with the top and bottom faces of fin walls 35. The fin members 33 are vertically stacked on core member 36 with walls 35 being mutually parallel and separated by spacers 34. The bottom fin member 37 defines a cap and includes a flat circular wall 38 integrally formed with the inner periphery of the conical wall 39 of fin member 37 and having a shallow cylindrical well firmly engaging and secured to the bottom outer border of core member 36. The upper fin member spacer section 40 extends above and below the top fin member conical wall and has an inwardly projecting peripheral flange 47 which engages to top edge of core member 36, spacer section 40 defining a retainer member secured to the core member.

Figure 6:
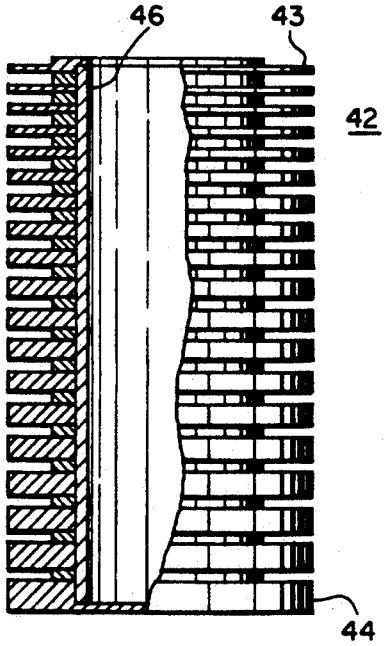
FIG. 6 is a view similar to FIG. 5 of still another embodiment of the invention.

In FIG. 6 of the drawings, there is illustrated a vase 42 constructed in accordance with the subject invention in which the fin members 43 are annuli of equal diameters but of different thicknesses, the bottom fin member being of greatest thickness and the fin member thicknesses decreasing with the height of the respective fin member. The bottom fin member 44 has a circular well formed therein and tightly engaging the bottom outer peripheral border of core member 46. In all other respects, the vase 42 is similar in construction to vase 10.

Figure 7:
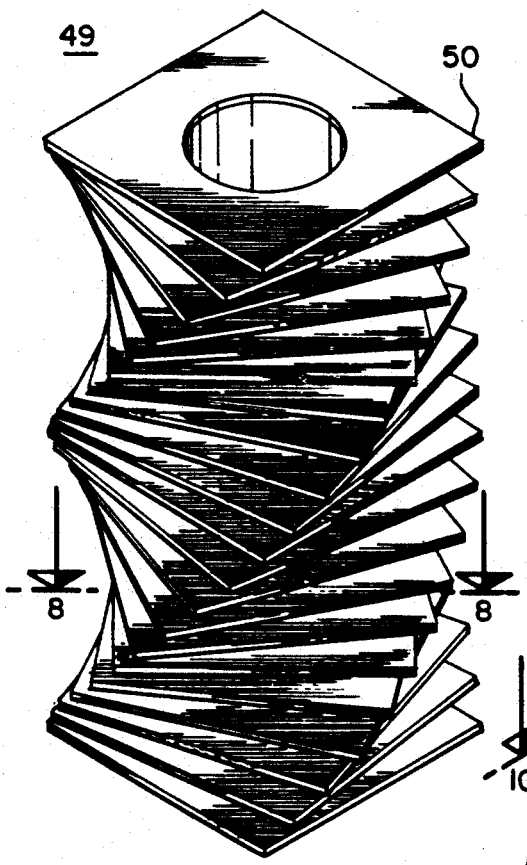
FIG. 7 is a front perspective view of a further embodiment of the invention.
Figure 8:
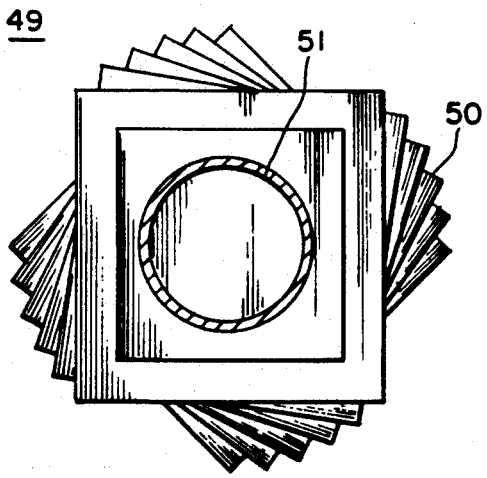
FIG. 8 is a sectional view taken along line 8—8 in FIG. 7.

The decorative article 49 shown in FIGS. 7 and 8 differs from that first described primarily in the shape and arrangement of the fin member 50. The fin members 50 are of equal dimensions each being square with a circular central opening of a diameter about equal to the outside diameter of the tubular core member 51 which is engaged by a stack of fin members 50. Fin members 50 are separated by square or otherwise shaped spacers and each is angularly displaced about the longitudinal axis of core member 51 relative to the next successive fin member 50. The core member 51 is closed at its bottom by a cap member restricting the downward movement of the assembled fin members and spacers which assembly is locked in position by a retainer member firmly engaging the top of core member 51. It should be noted that fin members 50 may be of polygonal shape other than square and may be of different dimensions and orientations.

Figure 9:
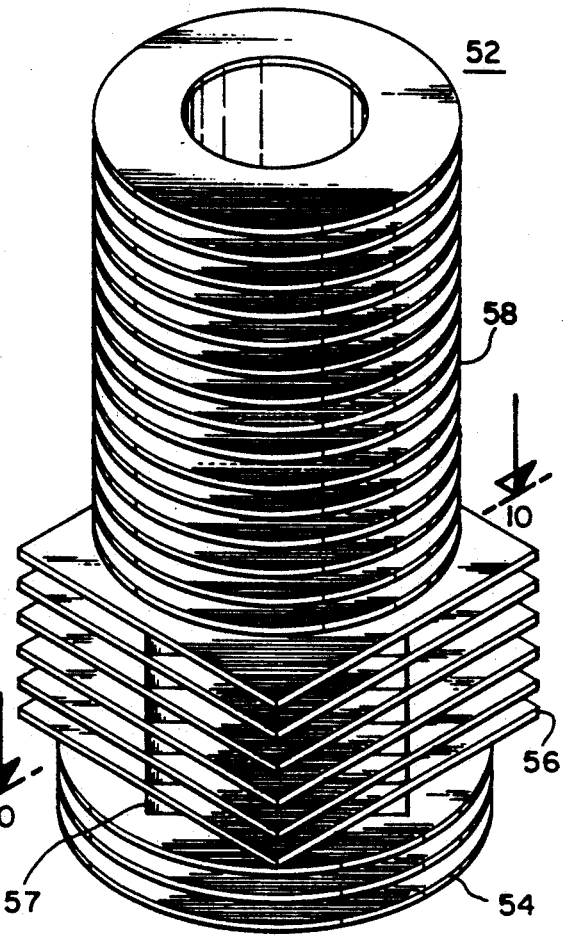
FIG. 9 is a front perspective view of still a further embodiment of the invention.
Figure 10:
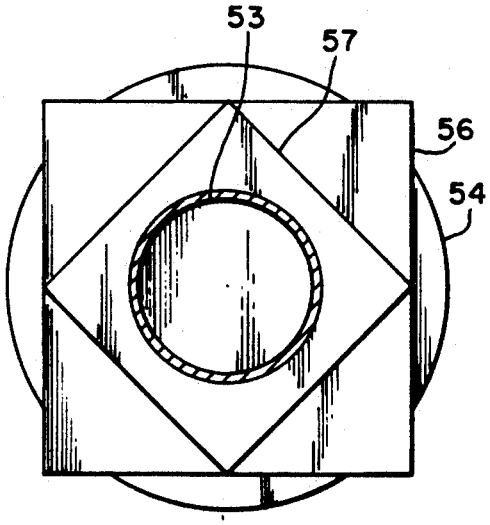
FIG. 10 is a sectional view taken along line 10—10 in FIG. 9.

The vase 52, shown in FIGS. 9 and 10, is another of many forms in which the vase may be constructed or adjusted employing the present construction. Vase 52 includes a tubular core member carrying many different sections of fin member groups which are locked on core member 53 by a flanged bottom cap and an upper retainer member. The vase 52 includes a bottom group of three circular fin members 54 separated by spacers, followed by a group of vertically aligned square fin members 56 separated by relatively thicker spacer members 57 whose diagonals equal the widths of fin members 56 and are axially displaced relative thereto 45 degrees, and the top most group includes fifteen spacer separated annular fin members 58. It should be noted that the sizes, dimensions, numbers and arrangements of the fin members may be varied, they may be formed of any suitable materials and may be colored and decorated as desired.

Figure 11:
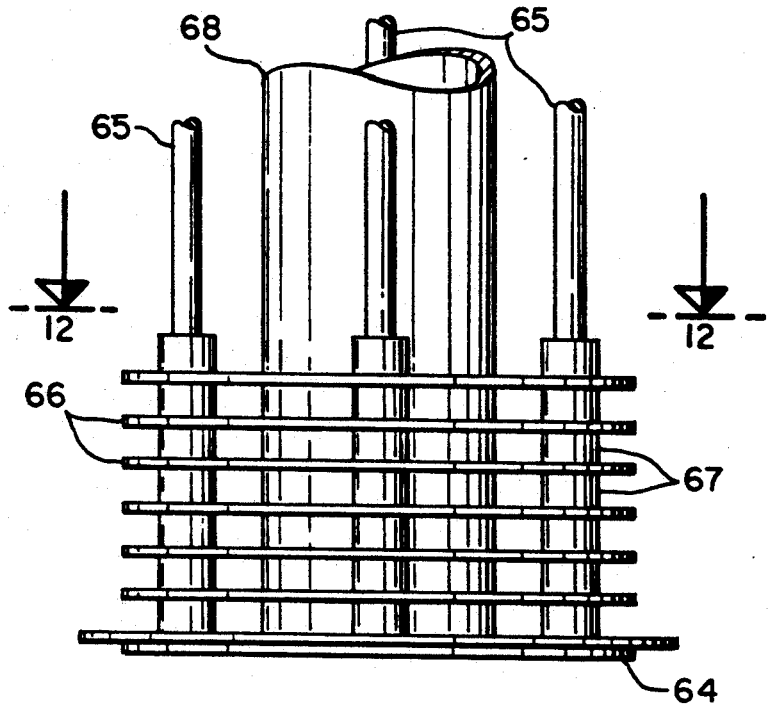
FIG. 11 is a fragmented front elevational view of a further embodiment of the present invention.
Figure 12:
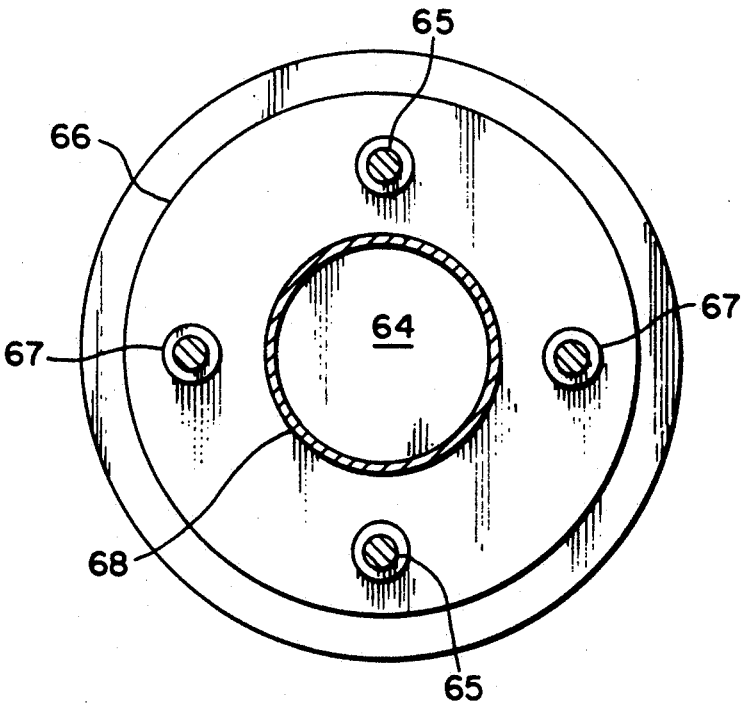
FIG. 12 is a fragmented sectional view taken along line 12—12 in FIG. 11.

In the embodiment of the present invention illustrated in FIGS. 11 and 12 of the drawings, the spacer members are mounted on circumferentially spaced vertical rods projecting from a base member. Specifically, the modified decorative device includes a circular base 64 and a plurality of vertical rods 65 located in a circle whose center is that of base member 64 and extending upwardly from and affixed to base member 64.

A plurality of circular disc-shaped fin members 66 are vertically spaced above and coaxial with base member 64 and have formed therein large circular central openings and smaller openings corresponding in location and diameter to that of rods 65. The rods 65 slidably engage the vertically aligned smaller eccentric openings in fin members 66 and also slidably engaged by rods 65 are equally dimensioned small spacer members 67 which are located between the confronting faces of successive base and fin members 64 and 66. An open topped tubular core member 68 of an outside dimension about that of the fin member central opening rests on base member 64 and extends upwardly coaxially with the fin members. In all other respects, the assembly and operation of the device 65 are similar to that of the earlier described embodiments and it may be made and modified as previously explained.

While there have been described and illustrated preferred embodiments of the present invention, it is apparent that numerous alterations, additions and omissions may be made without departing from the spirit thereof.

I claim:

1. A decorative article comprising a longitudinally extending hollow core member, a plurality of longitudinally spaced fin members having openings registering with said core member and being longitudinally slidable along said core member and a plurality of longitudinally spaced spacer members having openings for longitudinally slidably engaging said core member and interdigitating and being of lesser transverse dimensions than said fin members, successive fin members having peripheral borders delineating respective peripheral grooves.

2. The decorative article of claim 1 wherein said core member is cylindrical and tubular and is open at one end and closed at the opposite end thereof.

3. The decorative article of claim 2 wherein said fin members are of a frustoconical configuration.

4. The decorative article of claim 1 including an annulus engaging said core member at said open end and wherein said core member other end is enclosed by a cap, said annulus and cap having outer flanges longitudinally entrapping the assembly of said fin and spacer members on said core member.

5. The decorative article of claim 1 wherein said fin members are of similar shape and different dimensions.

6. The decorative article of claim 1 wherein said fin members are of flat annular configuration.

7. The decorative article of claim 1 wherein said fin members are of flat polygonal configuration.

8. The decorative article of claim 1 wherein said fin members are of different thicknesses.

9. The decorative article of claim 1 wherein said fin members are of frustoconical configurations.

10. The decorative article of claim 1 wherein said fin members are of a polygonal configuration and are relatively angularly offset about the longitudinal axis of said core member.

11. The decorative article of claim 1 wherein said spacer members are integrally formed with respective fin members.

12. A decorative article comprising a pair of transversely spaced longitudinally extending hollow core members, a plurality of longitudinally spaced fin members having openings registering with respective core members and being longitudinally slidable along said core members and a plurality of longitudinally spaced spacer members having openings engaging each of said core members and interdigitating and being of lesser transverse dimensions than adjacent fin members, the fin members on each of said core members projecting between the fin members on the other of said core members.

13. A decorative article comprising a base member, a plurality of circumferentially spaced rods affixed to and projecting upwardly from said base member, a plurality of coaxial vertically spaced fin members, each having small holes slidably engaging said rods and a large opening within the circumference of said small holes, a plurality of spacer members engaging each of said rods and interdigitating said fin members, and an open topped core vertical tubular member coaxial and registering with said fin member large openings.

14. The decorative article of claim 13 wherein said core member rests on said base member.

15. The decorative article of claim 13 wherein said spacer members are sandwiched between successive fin members.

16. A decorative article comprising a longitudinally vertically extending hollow cylindrical core member open at its top and closed at its bottom, a plurality of longitudinally vertically spaced fin members having openings registering with said core member and being longitudinally slidable along said members having openings longitudinally slidably engaging said core member and interdigitating and being of lesser transverse dimensions than said fin members.

* * * * *